United States Patent [19]

Fry

[11] 4,064,720

[45] Dec. 27, 1977

[54] CYLINDER LOCK MECHANISMS

[75] Inventor: Eric Fry, Toronto, Canada

[73] Assignee: Jonathan Lock Limited, Downsview, Canada

[21] Appl. No.: 772,484

[22] Filed: Feb. 28, 1977

[30] Foreign Application Priority Data

Mar. 26, 1976 United Kingdom ..... 11092/76
Dec. 22, 1976 United Kingdom ..... 53547/76

[51] Int. Cl.[2] ..... E05B 27/08

[52] U.S. Cl. ..... 70/363; 70/378; 70/419

[58] Field of Search ..... 70/363, 364 R, 364 A, 70/378, 419

[56] References Cited

U.S. PATENT DOCUMENTS

| | | | |
|---|---|---|---|
| 1,899,686 | 2/1933 | Henst | 70/222 |
| 3,410,123 | 11/1968 | Jacob | 70/364 R |
| 3,485,068 | 12/1969 | Bennett | 70/363 |
| 3,599,455 | 8/1971 | Pilvet | 70/363 |
| 3,604,231 | 9/1971 | Boschi | 70/363 |

*Primary Examiner*—Robert L. Wolfe
*Attorney, Agent, or Firm*—Ridout & Maybee

[57] ABSTRACT

In a cylinder lock mechanism of the type in which longitudinally movable pin tumblers are housed in a normally freely rotatable lock plug which is coupled to a locking member by means of a rocking lever responding to correct alignment of the tumblers, the resistance of the lock to picking, and to fouling and corrosion may be improved, and the structure made more compact, by making the lever part of a three part linkage, the lever being pivotless and actuated by the tumblers by a laterally movable diaphragm in the lock plug and acting upon a laterally movable clutch dog to couple the locking member to the plug. A decombinating cam is provided to ensure disengagement of the diaphragm from the tumblers on removal of a key from the mechanism, and provision may be made positively to lock the locking member against rotation except when the mechanism is freed for rotation by insertion of a correct key.

10 Claims, 12 Drawing Figures

Figure 7:
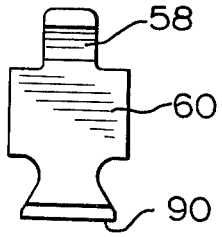

FIG. 1
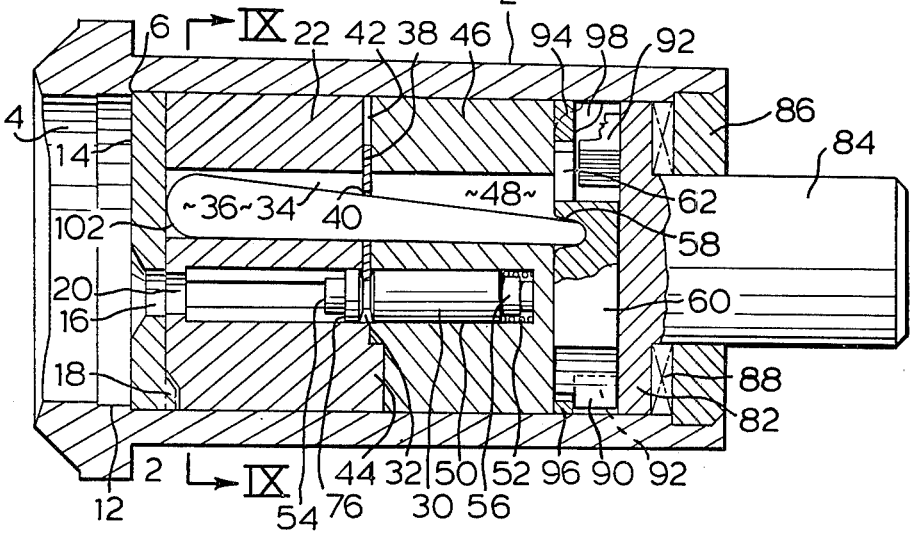
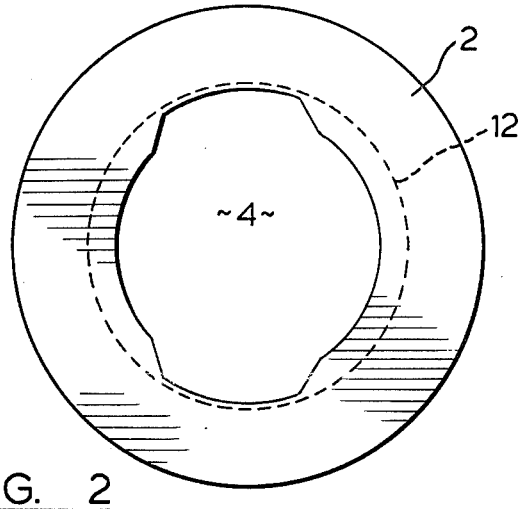
FIG. 2
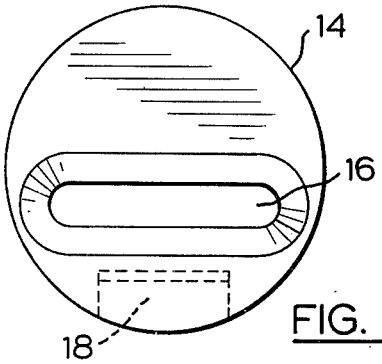
FIG. 3
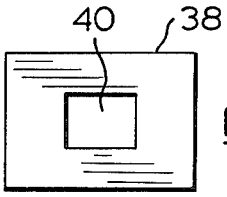
FIG. 5
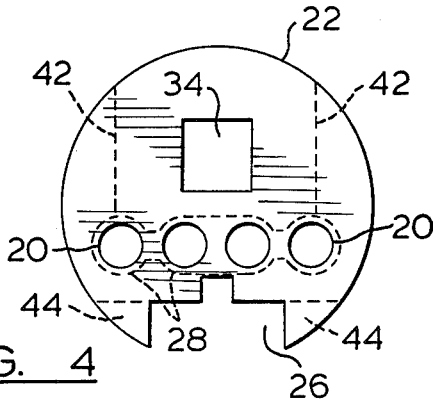
FIG. 4
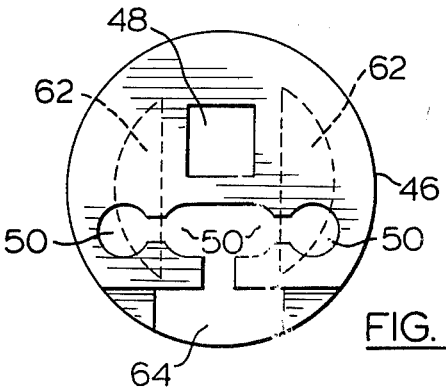
FIG. 6

CYLINDER LOCK MECHANISMS

This invention relates to cylinder lock mechanisms.

Such lock mechanisms are very widely used, but are not in general notable for a high degree of security against picking or other means of obtaining unauthorized operation of the mechanism.

Various forms of cylinder lock mechanism providing a higher degree of security have been evolved, but these in general have entailed increased dimensions and/or substantially increased complexity and difficulty of assembly. One relatively simple but highly effective form of high security cylinder lock mechanism is of the type described in British Patent Specification No. 1,227,731. In this mechanism a plug is freely rotatable within a cylinder, and a locking element is coaxial with but normally disengaged from the plug. A rocker element is pivotally mounted on the plug for rocking movement between a position out of engagement with the locking element and a position engaging the locking element, which latter position it can however only assume when a portion of the rocker element enters slots in a group of tumbler elements axially moveable in the plug by means of a key so as to bring the slots into alignment to receive the rocker element portion. Since the plug is freely rotatable in the cylinder, it is impossible for a lock picker to 'feel' the appropriate positions of the tumbler elements.

The rocker mechanism in known locks of this type has however resulted in a lock which is less compact than conventional cylinder locking mechanisms, and this has prevented their direct substitution for such mechanisms in order to improve the security of articles having a lock or locks and originally designed to incorporate conventional types of cylinder lock mechanism. Moreover, in certain environments such as coin operated washing machines, difficulty has been experienced in maintaining free pivoting action of the rocker due to fouling or corrosion of or adjacent the pivotal mounting.

The object of the present invention is to provide a lock mechanism of the general type described in U.S. Pat. No. 1,227,731 which can be of more compact construction, which can be more resistant to fouling and corrosion, which can be cheaper to manufacture, and which can offer even higher security.

According to the invention a cylinder lock mechanism comprises a body having a cylindrical bore, a lock plug extending longitudinally of the bore and normally freely rotatable therein, a plurality of pin tumblers housed in tumbler bores extending longitudinally within the plug and displaceable into predetermined longitudinal positions by insertion of a key into a keyway defined at the front end of the body and communicating with the tumbler bores, and a clutch member rotatable within the body to the rear of the plug, wherein a three part linkage extends between the tumblers and the clutch member comprising a transversely moveable actuator member normally disengaged from the tumblers and having a range of movement in a transverse guideway within the plug intermediate its ends so as to enter the tumbler bores in response to the tumblers simultaneously assuming said predetermined positions, a clutch dog between the plug and the clutch member and having a range of transverse movement into and out of a position coupling the plug and the clutch member, and a lever extending longitudinally in a lever bore in the plug parallel to but spaced from the tumbler bores, said lever being rockable about a fulcrum in said lever bore and engaging the actuator and the dog to coordinate their movements.

Figure 8:
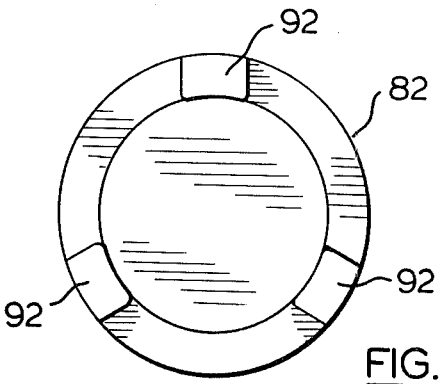
Figure 9:
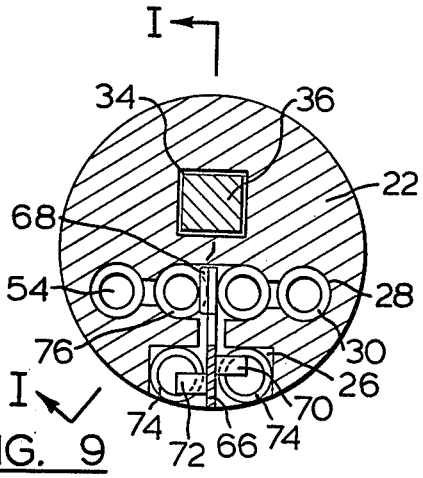
Figure 10:
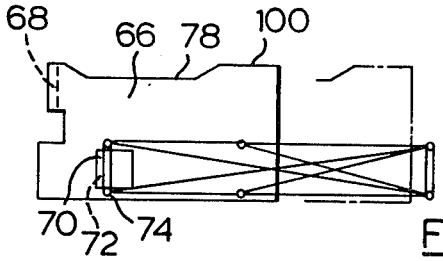
Figure 11:
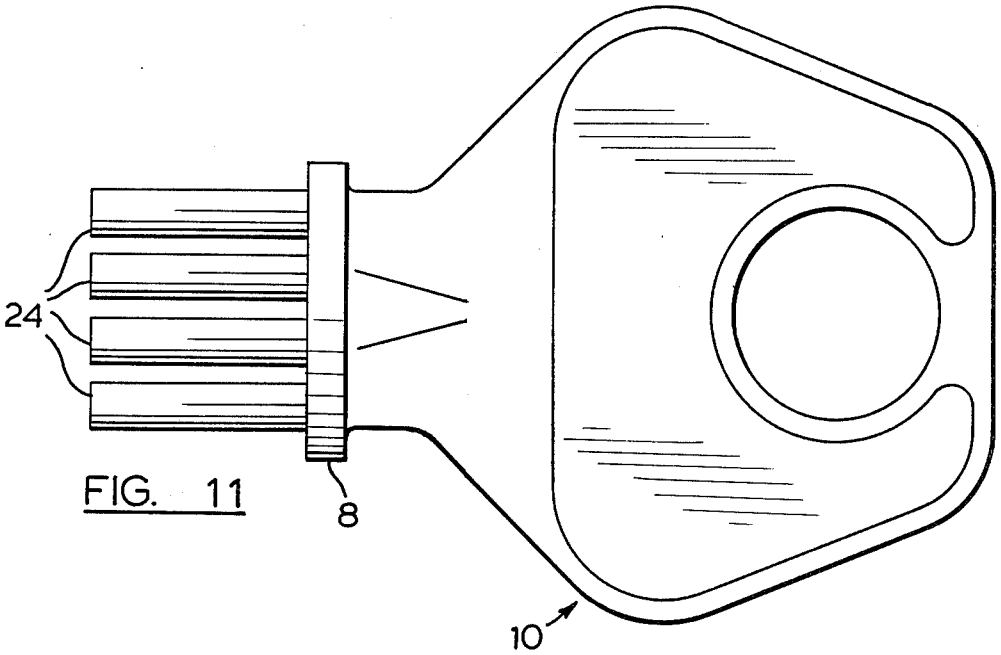
Figure 12:
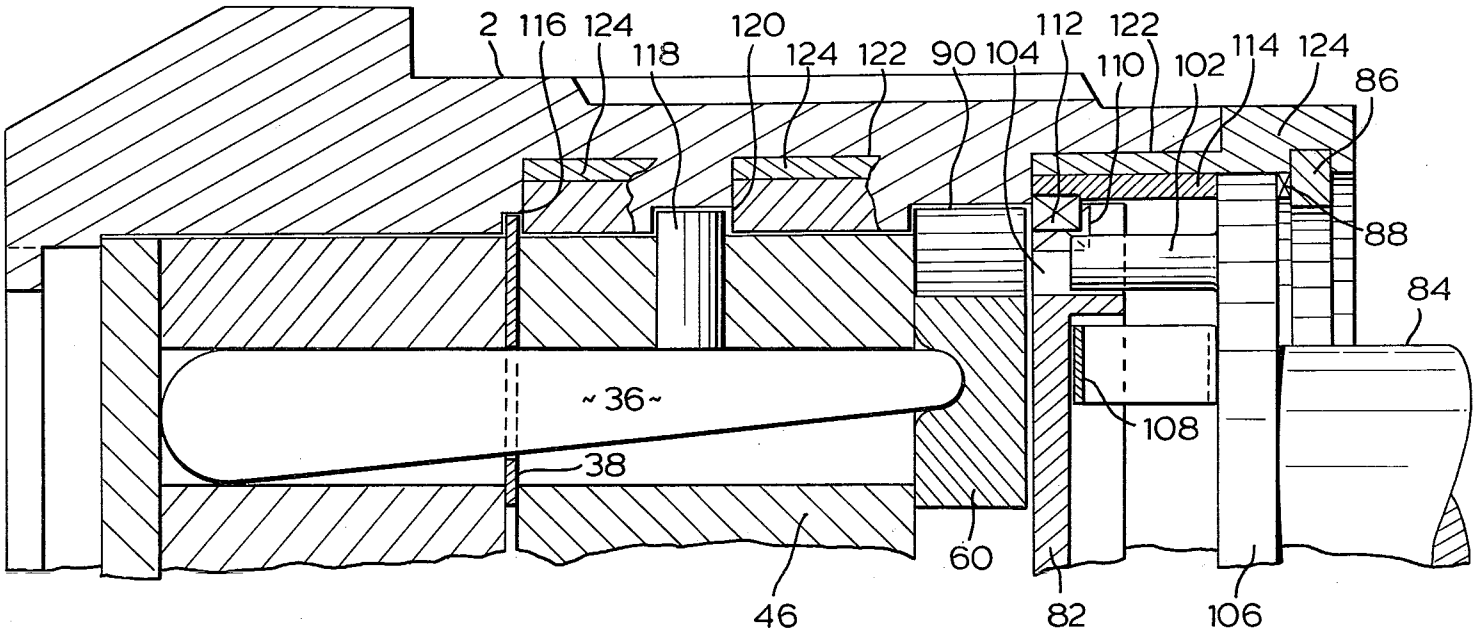

Other features of the invention will be apparent from the following description of preferred embodiments of the invention with reference to the accompanying drawings, in which FIG. 1 shows an axial section of a lock mechanism, on the line I—I in FIG. 9, FIG. 2 is a front end view of a housing of the mechanism, FIG. 3 is a front end view of a shield plate forming part of the mechanism, FIG. 4 is a front end view of a front plug of the mechanism, FIG. 5 is a front end view of a wafer forming part of the mechanism, FIG. 6 is a front end view of a rear plug of the mechanism, FIG. 7 is a front end view of a clutch dog forming part of the mechanism, FIG. 8 is a front end view of a clutch element forming part of the mechanism, FIG. 9 is a section on the line IX—IX in FIG. 1, FIG. 10 is an axial sectional detail illustrating the action of a decombinating cam, taken in the same plane as the upper half of FIG. 1 and at 45° to the lower half of FIG. 1, FIG. 11 shows a key blank for the preparation of keys for the mechanism, and FIG. 12 is a fragmentary axial section showing modifications of the lock mechanism of FIGS. 1–11.

Referring to FIGS. 1–11 of the drawings, the lock mechanism comprises a hollow cylindrical housing 2, having at its front end an opening 4 which is shaped to match the profile of a collar 8 on a key 10 (see FIG. 11) and thus to admit the key only when the latter is correctly oriented. A relieved portion 12 of the opening permits rotation of the key when fully inserted.

An abutment 6 in the internal bore of the housing serves to locate the various remaining portions of the mechanism, which are assembled into the housing from the rear. The first part so inserted is a shield plate 14, which may be of metal selected, hardened or toughened so as to provide a desired degree of resistance to drilling or other attempts to disrupt the mechanism from the front. It is formed with a keyway 16, and a lug 18 which serves to maintain the keyway in register with bores 20 in a front plug 22 which receives the pins 24 of the key 10, by engaging the front entrance to a recess 26 in the plug 22. The bores 20 are formed with interconnected counterbores 28 to receive pin tumblers in the form of bobbins 30, each formed with a circumferential groove 32 and a number of spaced shallower circumferential grooves (not shown). The location of the groove 32 differs on different bobbins, and the resulting numerous possible different combinations provide the differs for the lock mechanism, as will be further discussed below. A further bore 34, rectangular in cross section, provides in conjunction with the plate 14, a socket for the heel 102 of a tapering rocker lever 36.

An actuating member in the form of a wafer 38 is placed over the lever 36 so that the narrow end of the latter passes through a window 40 in the wafer, and the latter enters a rebate 42 in the rear end of the front plug 22. Lugs 44 on the rear end of the front plug locate a rear plug 46, which has a rectangular bore 48 aligned the bore 34, and blind interconnected bores 50, which together with the counterbores 28 accommodate the bobbins 30 and also springs 52 urging the bobbins 30 toward the bores 20 so that reduced diameter portions 54 of these bobbins enter and obturate the bores 20 by reason of having a shape complementary thereto. The springs are located by reduced diameter portions 56 on the rear of the bobbins.

The narrow end of the lever passes through the bore 48 and projects to the rear of the plug 46, where it engages a socket 58 in a clutch dog 60 which is moveable on a diametrical path along a guide defined between lugs 62 on the rear end of the plug 46, the length of the path being defined by the movement permitted by the lever 36 as it rocks in the bores 34 and 48.

In the recess 26 in the plug 22 and an aligned recess 64 in the plug 46 is a cam 66 comprising a plate lying in a radial plane, as best seen in FIG. 9 with flanges 68, 70 and 72 projecting therefrom in the form of outwardly bent lugs. The flanges 70 and 72 engage springs 74 which act against a rear end of the recess 64 so as to urge the cam 66 toward the plate 14, whilst the flange 68 overlies a shoulder 76 on one of the bobbins 30. A cam surface 78 on the inner edge of the cam 66 is engageable with the wafer 38.

All the parts described so far, with the exception of the housing and the key, form a single rotatable plug assembly within the housing. Also within the housing to the rear of this assembly is a rotatable clutch member 82 integral with a locking shaft 84 which may be utilized to operate a lock in any manner known in the cylinder lock art. The clutch member 82 is retained, and the entire mechanism held together, by a back plate 86 which cooperates with the housing 2 to complete the lock body. Between the back plate and the clutch member is a disc spring 88 urging the element toward the dog 60. When the dog is in the position shown in FIG. 1, its nose 90 is in the path of peripherally spaced abutments 92 on the element 82, so that rotation of the plug assembly also causes rotation of the shaft 84. The extent of rotation of the dog 60 in this position, and hence of the shaft 84, may optionally be limited by means of a stop projection 94 on a control ring 96 located against rotation relative to the housing by a lug 98.

In operation, a key as shown in FIG. 11, with the pins 24 reduced to appropriate lengths, is advanced to the lock mechanism so that the pins enter the keyway 16 and permit the plug assembly to be turned in the housing, if necessary, so that the collar 8 of the key can pass through the opening 4 into the relief 6. Although no key is shown in FIG. 1, it should be appreciated that the bobbin 30 which is shown is seen in the position to which it is moved by a fully inserted key, and the other bobbins are similarly displaced to predetermined positions so that the wafer 40 can enter their grooves 32. It will also be understood that the actual axial position of the displaced bobbins will vary according to the length of the associated key pins 24 and the axial position of the grooves 32 on the bobbin. When the key is withdrawn, the cam 66 is moved to the left by the springs 74 so that a portion 100 of the cam surface 78 pushes the wafer 38 upwardly clear of the bores containing the tumblers and hence causes the lever 36 to rock upwardly (as seen in FIG. 1) about its broad end. The narrow end of the lever therefore moves the dog 60 in a centralized position where its nose 90 cannot engage any of the abutments 92 on the clutch element 82. The disengagement of the wafer 38 from the grooves 32 permits the bobbins to move as far as they can to the left (as seen in FIG. 1) under the influence of the springs 52 so that their ends 54 block the bores 20 and prevent foreign matter from entering the lock.

When the key is inserted, one of the key pins engages the flange 68 on the cam 66 as well as a bobbin 30, and the bobbins and the cam are therefore driven to right. The depressed central portion of the cam surface 78 now provides clearance for downward movement of the wafer 38, but this cannot happen until the grooves 32 in all the bobbins are aligned with the wafer which will only occur when the correct key is inserted. The additional unshown shallow grooves provide an additional safeguard against picking of the lock mechanism, since a person attempting to pick the lock mechanism cannot tell which is the correct groove to align with the wafer even if he is able to 'feel' the grooves.

When the correct key is inserted, the wafter 38, together with the lever 36 and the dog 60, can drop to the positions shown in FIG. 1. In the embodiment shown, this occurs under the influence of gravity as the plug assembly is turned by the fully inserted key into an appropriate orientation. If the lock is mounted on a vertical or near vertical axis, such gravitational operation is not available, and in a lock for use in such positions, an additional spring will be required, acting on the wafer, the lever or the dog, so as to bring them to the position shown in FIG. 1. It is however usually preferred to omit the spring unless it is necessary since it provides a reaction force against which a skilled lock picker may 'feel' the operation of the mechanism. Once the positions of FIG. 1 have been attained, rotative movement of the plug assembly by the key can be transmitted to the shaft 84. The extent of this movement may be limited by the stop 94, which may also be associated with a cam acting on the dog to disengage it from the clutch once the latter has reached a predetermined angular position.

If an incorrect key is inserted, or when no key is inserted, the wafer 38 is positioned so that the lever 36 positively holds the dog 60 out of engagement with the clutch element 82, and thus the plug assembly remains freely rotatable in the housing 2, providing no reaction against which the operation of the mechanism can be 'felt' by a lock picker.

As compared with known lock mechanisms operating on the same general principle, the lock mechanism described above offers a number of advantages. The replacement of the pivoted lever previously used in such mechanisms to sense correct alignment of the tumblers and establish driving connection between the plug and the clutch by three separate components, the wafer 38, the lever 36 and the dog 60, not only enables a much more compact assembly to be achieved, so that the mechanism can be readily accommodated within the same dimensions as a cylinder lock mechanism, but also simplifies assembly, and improves reliability and security. The total number of components in the lock is not in fact substantially altered since some troublesome minor components such as locking and pivot pins are eliminated. The elimination of the lever pivot pin and its replacement by a fulcrum in the form of heel 102 simplifies assembly by eliminating the insertion of a pivot pin and the drilling of a bore for the pin. It also improves reliability since it is found that such pivots can cause malfunction of the lock when they become fouled with foreign matter such as soap, grease or corrosion. The use of the wafer instead of a portion of the lever to engage the grooves in the tumblers means that the bore containing the lever 36 is not joined by an open passage way to the bores containing the tumblers, as in previous lock mechanisms of this type. This greatly reduces the possibility of the lever becoming fouled or corroded by foreign matter, a possibility which is still further reduced by the closing of the bores 20 by the tumbler bobbins 30 when the latter are in their normal position. The elimination of the passage also eliminates any possibility of a probe being advanced into the mechanism, for example in order to jam the clutch into engagement. Additionally, the interposition of the wafer helps to prevent any possibility of movement of the lever being 'felt' by a lock picker. The use of a separate dog 60 helps to make the mechanism more compact since it can slide instead of swing and therefore requires less space, and can also be controlled in the manner described by the ring 96.

The formation of the plug in two portions facilitates assembly and provides an easy method of housing the wafer 38. The cam 66 acts when the key is withdrawn to cam the wafer out of engagment with the tumbler bobbins and thus ensure that the bobbins do not jam in their depressed position when the key is withdrawn.

In some instances, it is necessary that the locking shaft be secured against rotation until the lock mechanism is freed by the insertion of the correct key. In such instances the embodiment of FIG. 12 may be utilized.

The mechanism shown in FIG. 12 is generally similar to that described with reference to FIGS. 1–12, and only the points of difference will be described. Where applicable, the reference numerals employed are the same as those used in FIGS. 1–12.

The housing 2 is extended rearwardly so as to accommodate a sliding connection between the clutch element 82 and the locking shaft 84, which are no longer integral. Instead, the element and the shaft are coupled for rotational movement by pins 102 extending into apertures 104 in the clutch plate 82 from a drive plate 106 on the shaft which plate occupies the same position at the rear of the lock mechanism as was originally occupied by the clutch member 82. The clutch plate 82 may move axially rearwardly towards the drive plate 106 against the pressure of a wavy washer spring 108, which however normally urges external teeth 110 on the plate 82 into engagement with internal teeth 112 on a locking ring 114 located in the lock housing, thus preventing rotation of the plates 82 and 106 and the shaft 84 relative to the housing.

In order to disengage the teeth 110 and 112 so as to allow the shaft 84 to rotate, the clutch plate 82 must be pushed rearwardly against the pressure of the spring 108 by corresponding movement of those portions of the mechanism making up the plug of the lock. Such disengagement must of course only be permitted to occur when the correct key is inserted in the lock mechanism. One way of achieving this is to extend the nose 90 of the dog 60 so that, except when the key is inserted, the locking ring 114 forms an abutment adjacent the nose preventing rearward movement of the dog and thus the remainder of the mechanism.

In an alternative arrangement, the wafer 38 is extended so that it normally rests against an abutment 116 and is only withdrawn by the insertion of a correct key. In a further alternative arrangement, the plug 46 is drilled to receive a tumbler 118, which the lever 36 normally holds in engagement with an abutment 120.

Assembly of the modified lock mechanism may be facilitated by forming the body 2 with a counterbore 122 from the rear, accepting a sleeve 124 of appropriate length to accommodate the back plate 86, the drag washer 88, the locking ring 114, and spacer rings forming the abutments 116 and 120, if used.

What I claim is:

1. A cylinder lock mechanism comprising a body having a cylindrical bore, a lock plug extending longitudinally of the bore and normally freely rotatable therein, a plurality of pin tumblers housed in tumbler bores extending longitudinally within the plug and displaceable into predetermined longitudinal positions by insertion of a key into a keyway defined at the front end of the body and communicating with the tumbler bores, and a clutch member rotatable within the body to the rear of the plug, wherein a three part linkage extends between the tumblers and the clutch member comprising a transversely moveable actuator member normally disengaged from the tumblers and having a range of movement in a transverse guideway within the plug intermediate its ends so as to enter the tumbler bores in response to the tumblers simultaneously assuming said predetermined positions, a clutch dog between the plug and the clutch member and having a range of transverse movement into and out of a position coupling the plug and the clutch member, and a lever extending longitudinally in a lever bore in the plug parallel to but spaced from the tumbler bores, said lever being rockable about a fulcrum in said lever bore and engaging the actuator and the dog to coordinate their movements.

2. A lock mechanism according to claim 1, wherein the fulcrum of the lever is formed by a heel at its front end engaging a socket formed by the front end of the lever bore.

3. A lock mechanism according to claim 2 wherein the plug is divided into a front part and a rear part, and the actuator is a wafer located in a guide formed between the parts, the lever engaging the wafer by passing through a window in the latter.

4. A lock mechanism according to claim 1, and further comprising a cam located within the plug adjacent the tumbler bores, said cam being engageable for displacement in one direction by insertion of a key in the lock mechanism, spring means being housed within the plug in engagement with the cam to urge it in the other direction on withdrawal of the key along a path such as to expel said actuator from said tumbler bores by cam action.

5. A lock mechanism according to claim 1, wherein the tumblers are normally spring urged to positions at the front ends of the tumbler bores, the tumblers and bores having complementary configurations at their front ends so that the tumblers close the bores.

6. A lock mechanism according to claim 1, wherein the dog is slidable along its movement path in guides in the rear of the plug, and the clutch member has a plurality of peripherally spaced abutments, the dog having a nose engageable with any of the abutments only when said dog is at one end of its movement path.

7. A lock mechanism according to claim 1, wherein the plug and the clutch member are biased to a forward position in the body in which the clutch member is in interlocking engagement with the body whereby to prevent rotation of the former, and are moveable to an alternative rearward position in which there is no such interlocking engagement.

8. A lock mechanism according to claim 7, wherein a locking member is rotatably housed in the body of the lock mechanism behind the clutch member and is coupled to the clutch member for conjoint rotation therewith by means permitting longitudinal movement of the clutch member relative to the locking member.

9. A lock mechanism according to claim 8, wherein a compression spring acts between the locking member and the clutch member, which members are coupled by fingers extending from the locking member into sliding engagement with apertures in the clutch member.

10. A lock mechanism according to claim 7, wherein one of the actuator member, the dog and an auxiliary tumbler engaging the lever housed in a bore in the plug extending radially from the lever bore to the periphery of the plug extends into engagement with a peripheral abutment in the inner wall of the body, whereby to block rearwar movement of the plug when the actuator member is at that end of its movement path in which it is disengaged from the tumblers, and does not so extend when the actuator member enters the tumbler bores.

* * * * *